US008528939B2

(12) United States Patent
Turner et al.

(10) Patent No.: US 8,528,939 B2
(45) Date of Patent: Sep. 10, 2013

(54) MOUNTABLE COUPON CARD ASSEMBLY

(75) Inventors: James F. Turner, Farmington Hills, MI (US); Scott D. Best, Troy, MI (US)

(73) Assignee: Saxon, Inc., Ferndale, MI (US)

( * ) Notice: Subject to any disclaimer, the term of this patent is extended or adjusted under 35 U.S.C. 154(b) by 287 days.

(21) Appl. No.: 12/874,316

(22) Filed: Sep. 2, 2010

(65) Prior Publication Data

US 2011/0049861 A1 Mar. 3, 2011

Related U.S. Application Data

(60) Provisional application No. 61/239,108, filed on Sep. 2, 2009.

(51) Int. Cl.

| | |
|---|---|
| ***B42D 15/00*** | (2006.01) |
| ***G09F 3/00*** | (2006.01) |
| ***G09F 3/10*** | (2006.01) |
| ***B65D 65/28*** | (2006.01) |

(52) U.S. Cl.
USPC ..... 283/56; 428/43; 40/674; 40/675; 283/81

(58) Field of Classification Search
USPC ..... 283/56, 81; 40/674–675; 428/42.3, 428/43
See application file for complete search history.

(56) References Cited

U.S. PATENT DOCUMENTS

| | | | | |
|---|---|---|---|---|
| 3,804,323 | A | | 4/1974 | Bemel |
| 3,854,229 | A | | 12/1974 | Morgan |
| 4,306,367 | A | | 12/1981 | Otto |
| 4,308,679 | A | | 1/1982 | Ray, III et al. |
| 4,324,823 | A | | 4/1982 | Ray, III |
| 4,345,393 | A | | 8/1982 | Price et al. |
| 4,359,358 | A | | 11/1982 | Hattemer |
| 4,521,267 | A | * | 6/1985 | Jacobson ..... 428/43 |
| 4,620,664 | A | | 11/1986 | Kaufman et al. |
| 4,767,654 | A | | 8/1988 | Riggsbee |
| 5,227,209 | A | * | 7/1993 | Garland ..... 283/81 |
| 5,299,834 | A | * | 4/1994 | Kraige ..... 283/81 |
| 5,466,502 | A | * | 11/1995 | Wilkinson et al. ..... 428/42.1 |
| 5,571,358 | A | | 11/1996 | Napier et al. |

(Continued)

FOREIGN PATENT DOCUMENTS

GB 1292962 10/1972

OTHER PUBLICATIONS

Design U.S. Appl. No. 29/365,058, filed Jul. 2, 2010; 4 pages.
Design U.S. Appl. No. 29/355,898, filed Feb. 16, 2010; 17 pages.

*Primary Examiner* — Kyle Grabowski
(74) *Attorney, Agent, or Firm* — Howard & Howard Attorneys PLLC

(57) ABSTRACT

A coupon card assembly for attaching to a support structure is disclosed. The assembly includes a hinge partially cut through first and second layers of material and a liner to define a first and second card portion movable about a pivot axis. The first card portion includes a score line disposed along a width and cut through the first layer of material to define a segment of the first layer of material removable from the first card portion to expose one of a first and second layer of adhesive remaining on the first card portion for attaching the first card portion to the support structure. The score line is spaced from the pivot axis with at least a portion of the hinge continuing to include both of the first and second layers of material such that the hinge remains functional after removing the segment.

18 Claims, 11 Drawing Sheets

(56) References Cited

U.S. PATENT DOCUMENTS

| | | | | |
|---|---|---|---|---|
| 5,776,287 | A * | 7/1998 | Best et al. | 283/81 |
| 5,824,380 | A | 10/1998 | Hagen | |
| 5,970,640 | A * | 10/1999 | Farrow | 283/81 |
| 6,042,149 | A | 3/2000 | Roshkoff | |
| 6,096,397 | A * | 8/2000 | Murphy | 428/42.3 |
| 6,228,451 | B1 * | 5/2001 | Boudouris et al. | 428/43 |
| 6,241,287 | B1 * | 6/2001 | Best et al. | 283/81 |
| 6,331,018 | B1 * | 12/2001 | Roth et al. | 283/81 |
| 6,364,364 | B1 * | 4/2002 | Murphy | 283/81 |
| 6,402,086 | B1 | 6/2002 | Myers, Jr. | |
| 6,589,623 | B2 * | 7/2003 | Roth | 283/81 |
| 6,974,159 | B2 | 12/2005 | Thompson et al. | |
| 7,140,135 | B2 | 11/2006 | Irvine et al. | |
| 2002/0079691 | A1 * | 6/2002 | Zumberge | 283/81 |
| 2003/0177674 | A1 | 9/2003 | Miller | |
| 2004/0074128 | A1 * | 4/2004 | Best et al. | 40/674 |
| 2004/0084891 | A1 * | 5/2004 | Linn | 283/56 |
| 2005/0206157 | A1 | 9/2005 | Thompson et al. | |
| 2006/0038396 | A1 | 2/2006 | Thompson et al. | |
| 2007/0065619 | A1 | 3/2007 | Sellars | |
| 2007/0114784 | A1 * | 5/2007 | Martin | 283/56 |
| 2007/0148393 | A1 | 6/2007 | Sellars | |
| 2008/0142394 | A1 | 6/2008 | Thuesen et al. | |
| 2009/0058073 | A1 | 3/2009 | George | |
| 2011/0259775 | A1 * | 10/2011 | Bratter et al. | 206/449 |

* cited by examiner

FIG. 6
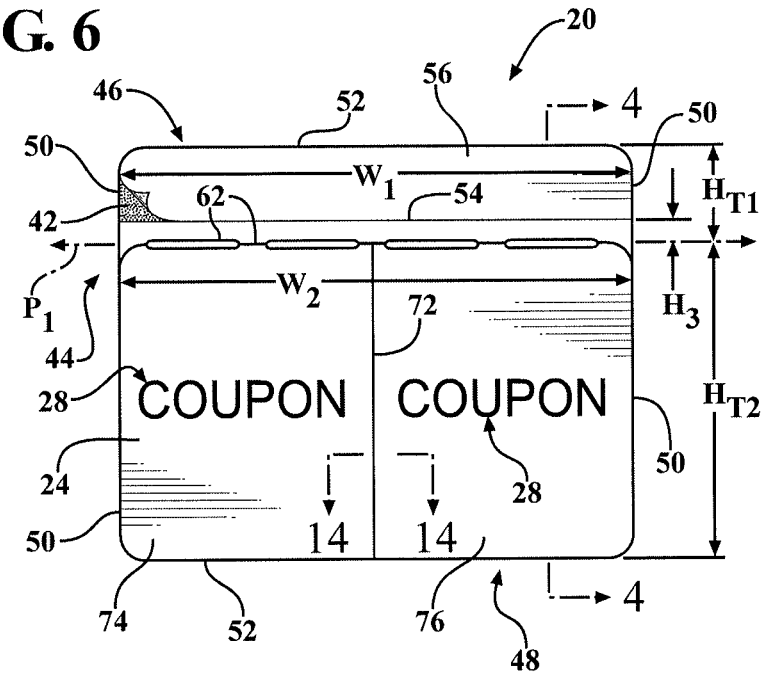
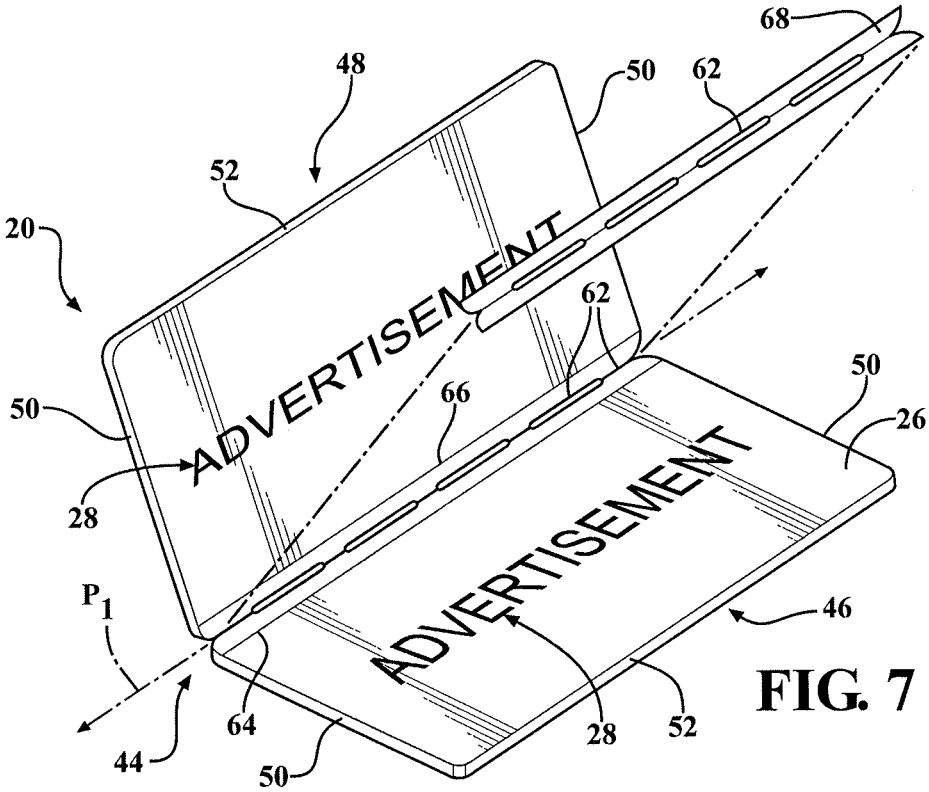
FIG. 7

FIG. 8
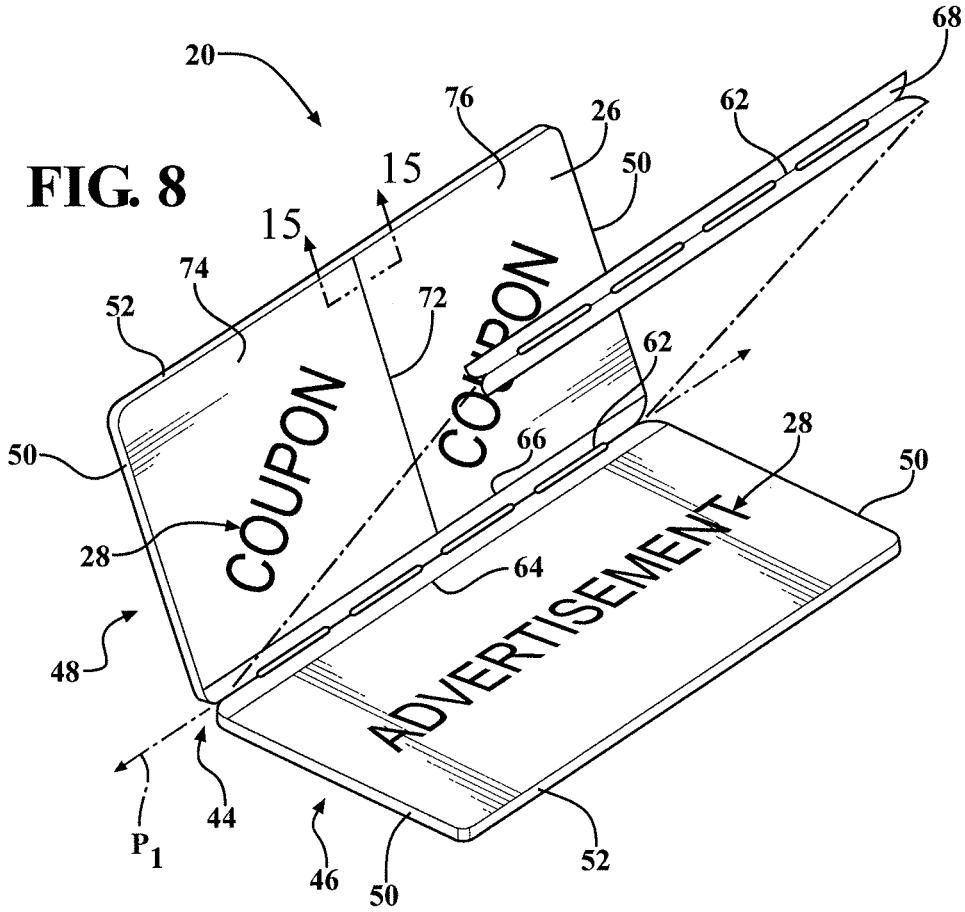
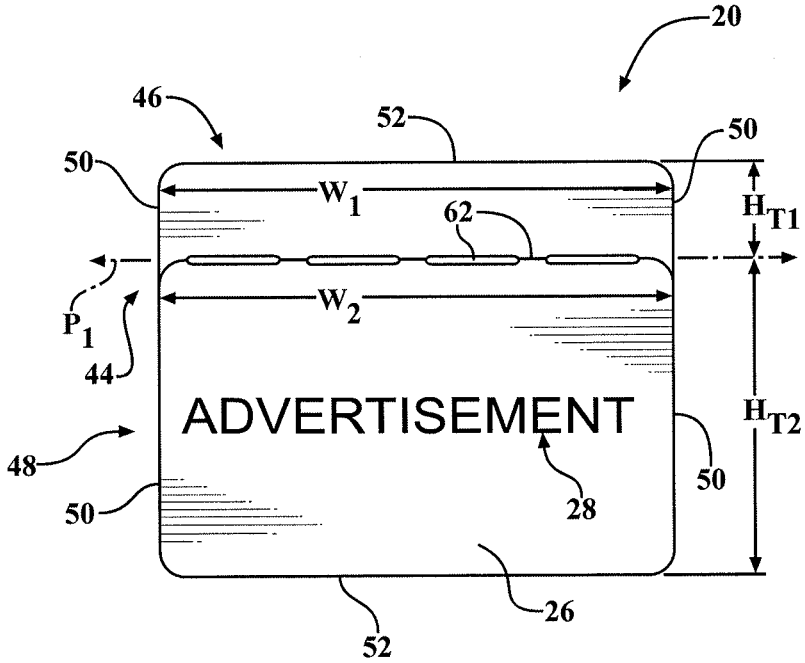
FIG. 9

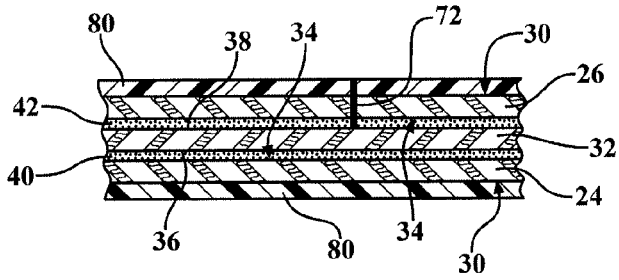
FIG. 15
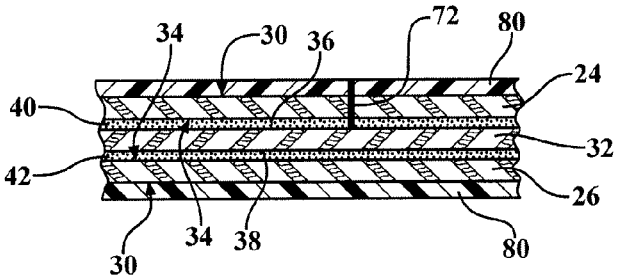
FIG. 16
FIG. 19
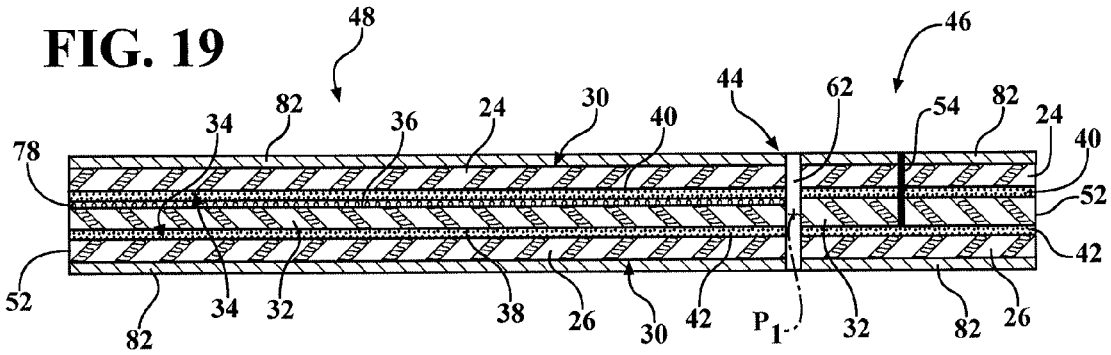

MOUNTABLE COUPON CARD ASSEMBLY

CROSS REFERENCE TO RELATED APPLICATION

This application claims the benefit of U.S. Provisional Patent Application Ser. No. 61/239,108, filed on Sep. 2, 2009, the disclosure of which is hereby incorporated by reference.

BACKGROUND OF THE INVENTION

1. Field of the Invention

The subject invention generally relates to a coupon card assembly for attaching to a support structure.

2. Description of the Related Art

Various types of coupon cards are known in the art. For example, one type of coupon card includes a plurality of coupons given to a consumer after the consumer purchases an item from a store. Another type of coupon card is foldable such that the coupon card fits into the consumer's wallet after the consumer purchases the item from the store. These types of coupon cards are typically placed in the consumer's bag or handed to the consumer when exiting the store. In other words, these coupon cards are loose and therefore, these coupon cards are easily lost or misplaced before the consumer even has a chance to look at the coupon card because these types of coupon cards are not attached to any kind of support structure.

Therefore, there remains an opportunity to develop a coupon card assembly for attaching to a support structure.

SUMMARY OF THE INVENTION AND ADVANTAGES

The subject invention provides for a coupon card assembly for attaching to a support structure. The assembly includes a first layer of material, a second layer of material coupled to the first layer of material, and a liner disposed between the first and second layers of material. The assembly further includes a first layer of adhesive disposed between the first layer of material and the liner for attaching the first layer of material to the liner and a second layer of adhesive disposed between the second layer of material and the liner for attaching the second layer of material to the liner. The assembly also includes a hinge partially cut through the first and second layers of material and the liner to define a first card portion and a second card portion movable relative to the first card portion about a pivot axis with the first and second card portions each having opposing side edges defining a width therebetween. The first card portion includes a score line disposed along the width and cut through the first layer of material to define a segment of the first layer of material removable from the first card portion to expose one of the first and second layers of adhesive remaining on the first card portion for attaching the first card portion to the support structure. The score line is spaced from the pivot axis with at least a portion of the hinge continuing to include both of the first and second layers of material such that the hinge remains functional after removing the segment.

The subject invention also provides for the coupon card assembly for attaching to the support structure including the first layer of material and the second layer of material coupled to the first layer of material. The assembly includes the liner disposed between the first and second layers of material and having a first side and a second side opposing the first side. The first layer of adhesive is disposed between the first layer of material and the first side of the liner for coupling the first layer of material to the liner and the second layer of adhesive is disposed between the second layer of material and the second side of the liner for coupling the second layer of material to the liner. The hinge is partially cut through the first and second layers of material and the liner to define the first card portion and the second card portion movable relative to the first card portion about the pivot axis. The assembly further includes a masking disposed on at least one of the first and second sides of the liner of the second card portion without being disposed on the liner of the first card portion for concealing one of the first and second layers of adhesive of the second card portion.

Therefore, the subject invention provides for the segment of the first layer of material removable from the first card portion to expose one of the first and second layers of adhesive remaining on the first card portion for attaching the first card portion to the support structure. Attaching the coupon card assembly to the support structure eliminates losing the coupon card as discussed in the background of the invention section. Further, attaching the coupon card assembly to the support structure provides a desirable way to advertise. In addition, the subject invention provides for the hinge remaining functional even after removing the segment; thus the second card portion can be folded over the first card portion or detached from the first card portion as desired.

BRIEF DESCRIPTION OF THE DRAWINGS

Advantages of the present invention will be readily appreciated, as the same becomes better understood by reference to the following detailed description, when considered in connection with the accompanying drawings.

FIG. 6 is a plan view of the coupon card assembly with a first layer of material facing out and the second card portion having coupons thereon.

FIG. 7 is a perspective view of a first card portion and the second card portion with a second layer of material facing out and a hinge between the first and second card portions with a part of the hinge removed and the first and second card portions having advertisement thereon.

FIG. 8 is a perspective view of the first card portion with advertisement thereon and the second card portion with coupons thereon and the part of the hinge removed with the second layer of material facing out.

FIG. 9 is a plan view of the front of the coupon card assembly of FIG. 6 with the second card portion having advertisement thereon and the second layer of material facing out.

FIG. 15 is a broken cross-sectional view of the second card portion taken from lines 15-15 of FIG. 8.

FIG. 16 is a broken cross-sectional view of the second card portion taken from lines 16-16 of FIG. 11.

FIG. 19 is a cross-sectional view of the coupon card assembly having a varnish disposed on the first and second layers of material.

DETAILED DESCRIPTION OF THE INVENTION

Figure 1:
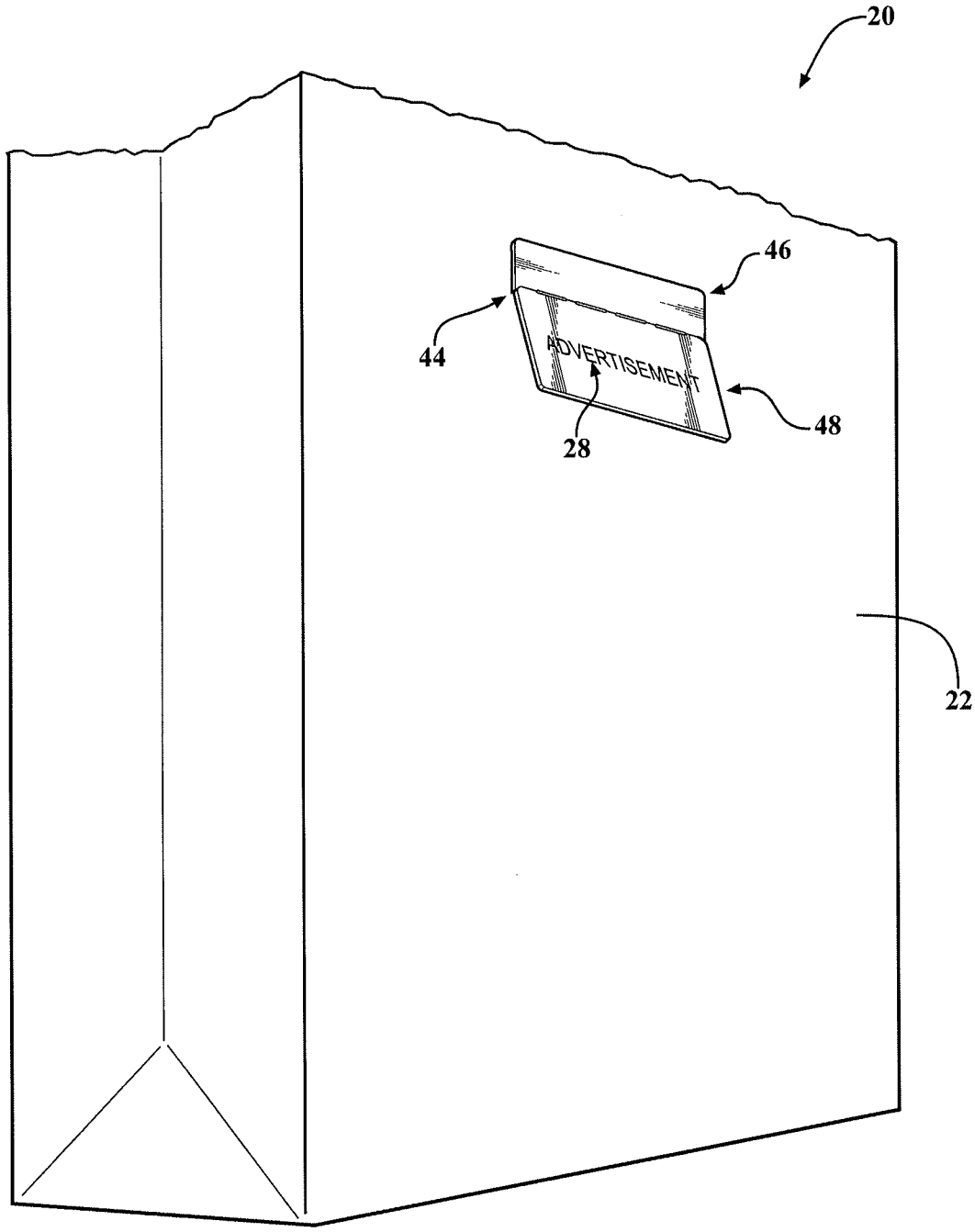
FIG. 1 is a perspective view of a coupon card assembly attached to a support structure defined as a bag.
Figure 2:
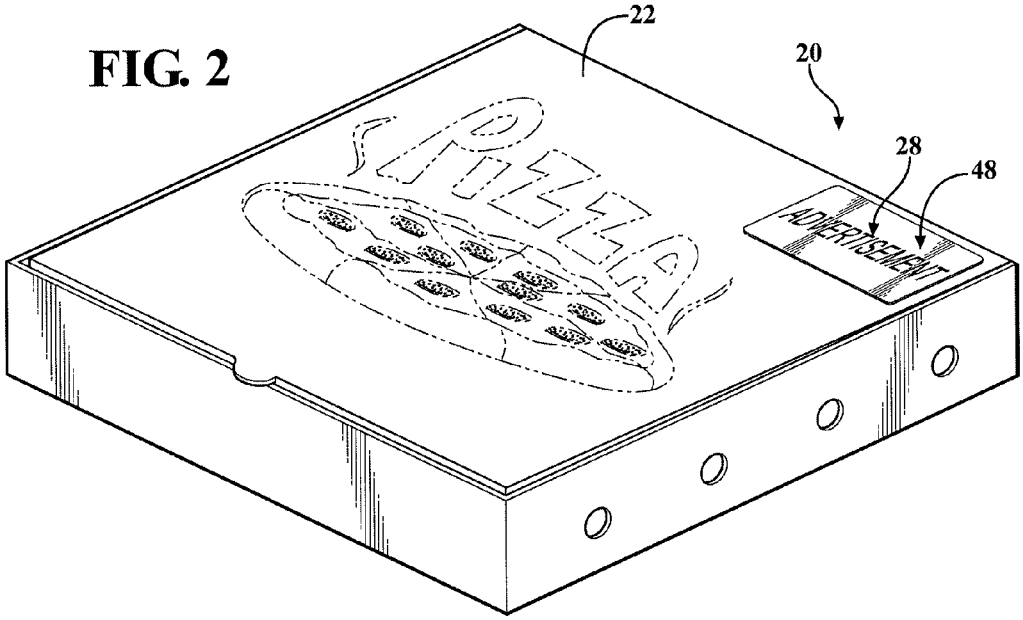
FIG. 2 is a perspective view of the coupon card assembly attached to the support structure defined as a box with the coupon card assembly in a closed position.
Figure 3:
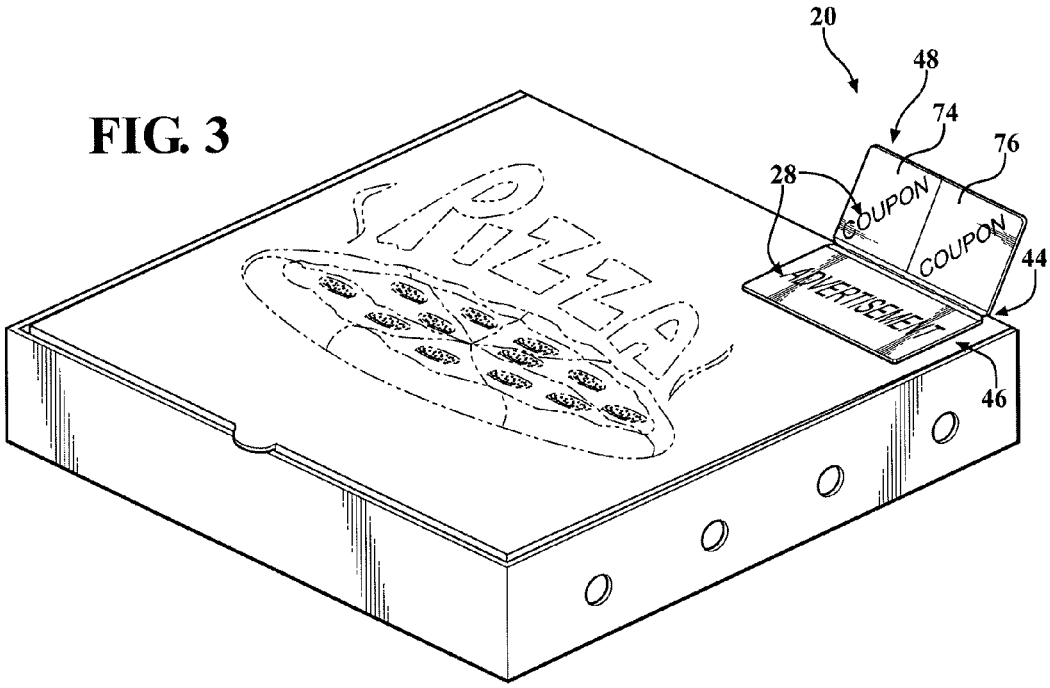
FIG. 3 is a perspective view of the coupon card assembly attached to the box with the coupon card assembly in an open position.

Referring to the Figures, wherein like numerals indicate like or corresponding parts throughout the several views, a coupon card assembly 20 for attaching to a support structure 22 is generally shown in FIGS. 1-3, 6-11, and 20-23. In other words, the coupon card assembly 20 is mountable to a support structure 22. For illustrative purposes only, the support structure 22 can be further defined as a bag as shown in FIG. 1, or a box as shown in FIGS. 2 and 3. The support structure 22 can be further defined as a shopping bag, a grocery store bag, a pizza box, a carry-out container, a container, or any other suitable support structure 22 for delivering the coupon card assembly 20 to a consumer.

Figure 4:
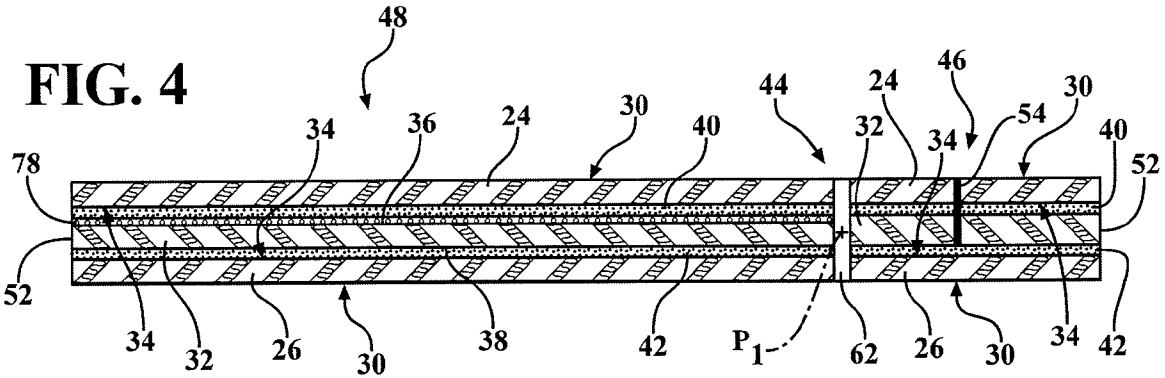
FIG. 4 is a cross-sectional view of the coupon card assembly taken from lines 4-4 of FIG. 6 with a masking disposed on a first side of a liner of a second card portion.
Figure 5:
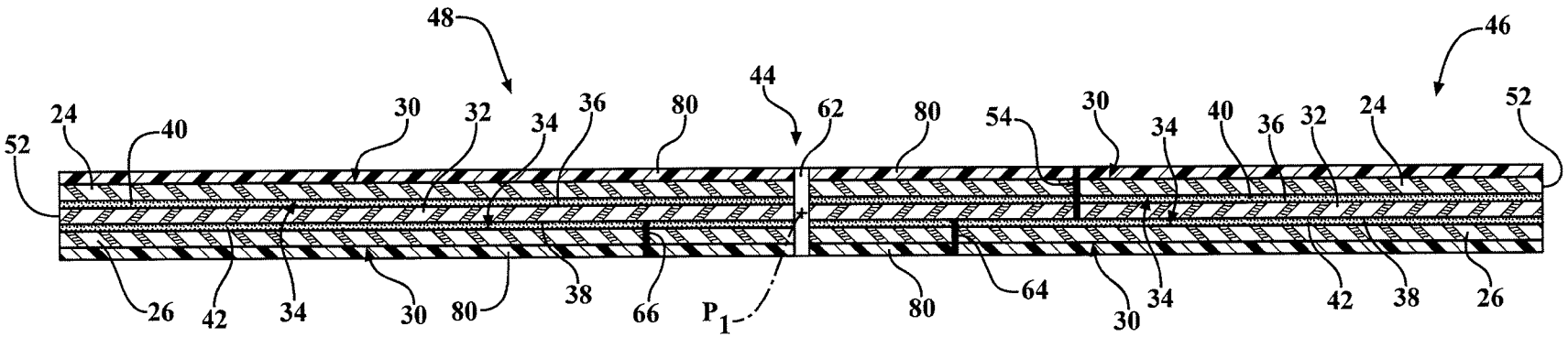
FIG. 5 is a cross-sectional view of the coupon card assembly taken from lines 5-5 of FIG. 10.

As best shown in FIGS. 4 and 5, the coupon card assembly 20 includes a first layer of material 24 and a second layer of material 26 coupled to the first layer of material 24. The first and second layers of material 24, 26 can be formed of a paper material, a synthetic material, a semi-gloss material, a polyester material, a tag material, and/or any other suitable material(s). For example, the first and second layers of material 24, 26 can be formed of a heavy weight stock material or a light weight stock material, etc.

Referring to FIGS. 1-3, 6 and 7, optionally, indicia 28 and/or printed matter can be printed or disposed on at least one of the first and second layers of material 24, 26. Also referring to FIGS. 4 and 5, the first and second layers of material 24, 26 each include an exterior surface 30 with indicia 28 and/or printed matter optionally disposed on the exterior surface 30 of at least one of the first and second layers of material 24, 26. Typically, indicia 28 and/or printed matter is printed or disposed on the exterior surface 30 of both the first and second layers of material 24, 26. For example, indicia 28 and/or printer matter can be further defined as promotional discounts, coupons, informational messages, advertisements, logos, and related information printed or disposed on the exterior surface 30 of at least one of the first and second layers of material 24, 26. It is to be appreciated that any suitable type of information can be printed or disposed on either or both of the first and second layers of material 24, 26.

The coupon card assembly 20 further includes a liner 32 disposed between the first and second layers of material 24, 26. In other words, the liner 32 is sandwiched between the first and second layers of material 24, 26. More specifically, the first and second layers of material 24, 26 each include an interior surface 34 opposing the exterior surface 30 of respective first and second layers of material 24, 26 with the liner 32 disposed between the interior surface 34 of the first and second layers of material 24, 26. The liner 32 includes a first side 36 and a second side 38 opposing the first side 36 with the interior surface 34 of the first layer of material 24 facing the first side 36 of the liner 32 and the interior surface 34 of the second layer of material 26 facing the second side 38 of the liner 32. Typically, at least one of the first and second sides 36, 38 of the liner 32 is releasable for allowing at least one of the first and second layers of material 24, 26 to be removable from the coupon card assembly 20. Alternatively, both the first and second sides 36, 38 of the liner 32 are releasable. The liner 32 can be formed of a paper material, a synthetic material, a polyester material, a semi-gloss material, a tag material, and/or any other suitable material. For example, the liner 32 can be formed of a heavy weight stock material or a light weight stock material, etc.

The coupon card assembly 20 also includes a first layer of adhesive 40 disposed between the first layer of material 24 and the liner 32 for attaching the first layer of material 24 to the liner 32. Likewise, the coupon card assembly 20 also includes a second layer of adhesive 42 disposed between the second layer of material 26 and the liner 32 for attaching the second layer of material 26 to the liner 32. More specifically, the first layer of adhesive 40 is disposed between the first layer of material 24 and the first side 36 of the liner 32 for coupling the first layer of material 24 to the liner 32. Likewise, the second layer of adhesive 42 is disposed between the second layer of material 26 and the second side 38 of the liner 32 for coupling the second layer of material 26 to the liner 32. Even more specifically, the first layer of adhesive 40 is disposed between the interior surface 34 of the first layer of material 24 and the first side 36 of the liner 32 and the second layer of adhesive 42 is disposed between the interior surface 34 of the second layer of material 26 and the second side 38 of the liner 32. In other words, the first and second layers of adhesive 40, 42 adhere the first and second layers of material 24, 26 to the liner 32. The first and second layers of adhesive 40, 42 can be formed of an adhesive of general purpose, such as, for example, a permanent adhesive, a removable adhesive, an ultra-removable adhesive, etc. It is to be appreciated that the first and second layers of adhesive 40, 42 can be formed of any other suitable adhesive(s).

Figure 10:
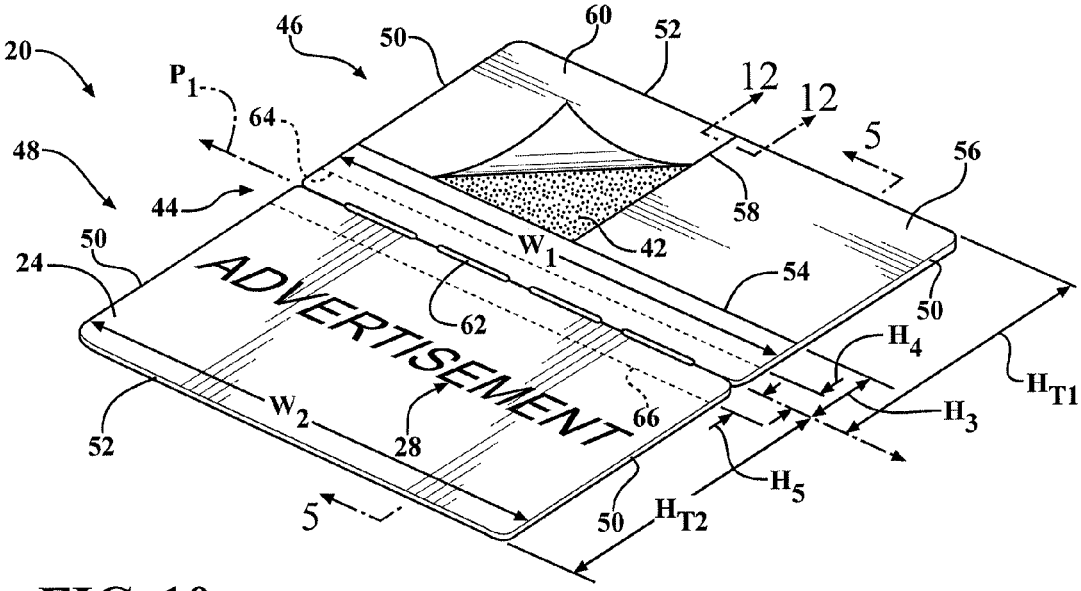
FIG. 10 is a perspective view of the first card portion including a segment removable from the first card portion and the second card portion with advertisement thereon and the first layer of material facing out.

As best shown in FIGS. 6-9, the coupon card assembly 20 further includes a hinge 44 partially cut through the first and second layers of material 24, 26 and the liner 32 to define a first card portion 46 and a second card portion 48 movable relative to the first card portion 46 about a pivot axis $P_1$. As best shown in FIGS. 9 and 10, the first and second card portions 46, 48 each have opposing side edges 50 defining a width $W_1$, $W_2$ therebetween. The width $W_1$ of the first card portion 46 typically equals the width $W_2$ of the second card portion 48. It is to be appreciated that the width $W_1$ of the first card portion 46 can be less than or greater than the width $W_2$ of the second card portion 48 as desired.

The first and second card portions 46, 48 each include a distal edge 52 adjacent respective side edges 50. The first card portion 46 has a first total height $H_{T1}$ extending from the distal edge 52 of the first card portion 46 to the pivot axis $P_1$ and the second card portion 48 has a second total height $H_{T2}$ extending from the distal edge 52 of the second card portion 48 to the pivot axis $P_1$. As shown in FIG. 9, the first total height $H_{T1}$ of the first card portion 46 is less than the second total height $H_{T2}$ of the second card portion 48. Alternatively, as shown in FIG. 10, the first total height $H_{T1}$ of the first card portion 46 equals the second total height $H_{T2}$ of the second card portion 48. For the alternative shown in FIG. 10, typically, the first and second total heights $H_{T1}$, $H_{T2}$ equal each other such that the first card portion 46 complements the second card portion 48 when the second card portion 48 is rotated about the pivot axis $P_1$; thus, the second card portion 48 folds over the first card portion 46. The second card portion 48 can fold over the first card portion 46 such that the first layer of material 24 of the first and second card portions 46, 48 faces each other. Likewise, the second card portion 48 can fold over the first card portion 46 such that the second layer of material 26 of the first and second card portions 46, 48 faces each other. It is to be appreciated that the first total height $H_{T1}$ of the first card portion 46 can be greater than the second total height $H_{T2}$ of the second card portion 48.

Optionally, as discussed above, indicia 28 and/or printed matter can be printed or disposed on at least one of the first and second layers of material 24, 26. More specifically, indicia 28 and/or printed matter can be printed or disposed on least one of the first and second card portions 46, 48. In one alternative as shown in FIGS. 3, 7, and 8, advertisement is printed on the first card portion 46. In another alternative as shown in FIGS. 1, 2, 7, 9, 10, 20, and 22, the advertisement is printed on the second card portion 48. In yet another alternative as shown in FIG. 7, the advertisement is printed on both the first and second card portions 46, 48.

Turning to FIGS. 4-6, 10, 11, 21, and 23, the first card portion 46 includes a score line 54 disposed along the width $W_1$ and cut through the first layer of material 24 to define a segment 56 of the first layer of material 24 removable from the first card portion 46 to expose one of the first and second layers of adhesive 40, 42 remaining on the first card portion 46 for attaching the first card portion 46 to the support structure 22. The score line 54 is spaced from the pivot axis $P_1$ with at least a portion of the hinge 44 continuing to include both of the first and second layers of material 24, 26 such that the hinge 44 remains functional after removing the segment 56. The score line 54 is further cut through the first layer of adhesive 40 and the liner 32 to further define the segment 56 removable from the first card portion 46 to expose the second layer of adhesive 42 remaining on the first card portion 46. In other words, when the segment 56 is removed from the first card portion 46, the segment 56 includes the first layer of material 24, the first layer of adhesive 40, and the liner 32. When the second layer of adhesive 42 is exposed, the coupon card assembly 20 can be adhered to the support structure 22. In other words, the second layer of adhesive 42 of the first card portion 46 engages the support structure 22 to adhere the coupon card assembly 20 thereon. When the first card portion 46 is attached to the support structure 22, the second card portion 48 can rotate about the pivot axis $P_1$. The score line 54 is further defined as a first score line 54 and will be referred to as the first score line 54 for the remaining discussion below.

Figure 11:
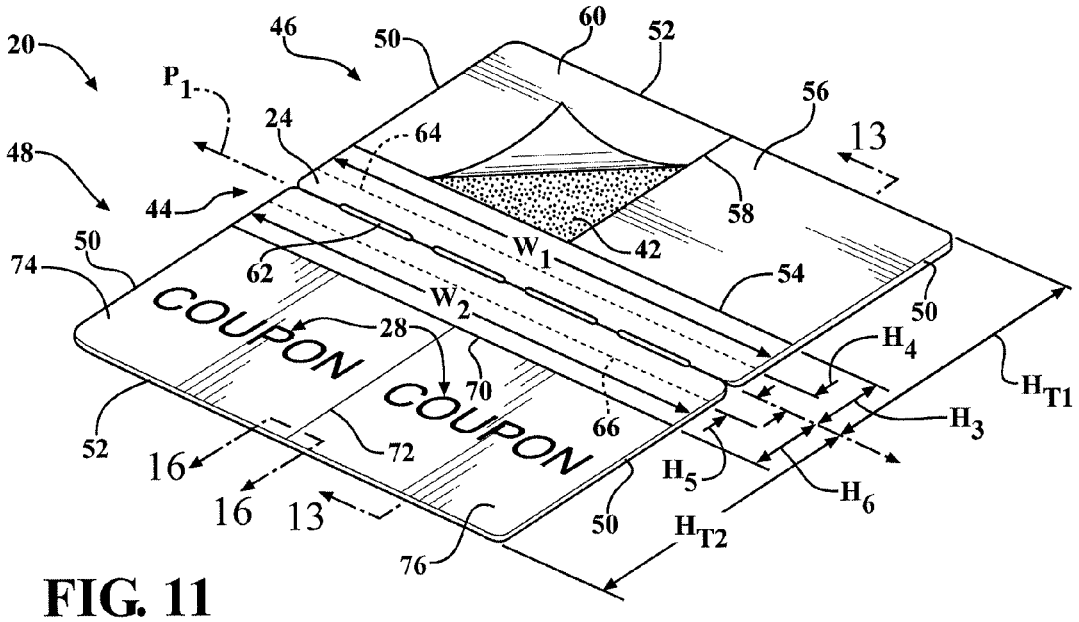
FIG. 11 is a perspective view of the second card portion with coupons thereon and the first card portion including the segment and the first layer of material facing out.
Figure 12:
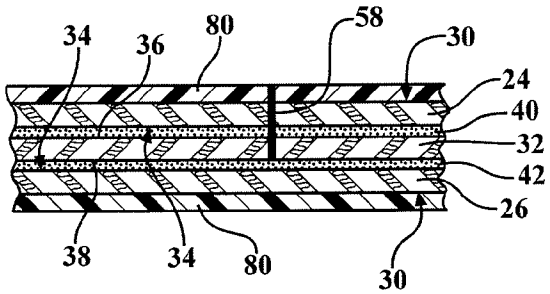
FIG. 12 is a broken cross-sectional view of the first card portion taken from lines 12-12 of FIG. 10.

Optionally, as shown in FIGS. 10-12, the first card portion 46 includes a segment score line 58 transverse to the first score line 54 and cut through the first layer of material 24 to define a first segment 56 and a second segment 60 of the first layer of material 24 removable from the first card portion 46 to expose one of the first and second layers of adhesive 40, 42 remaining on the first card portion 46 for attaching the first card portion 46 to the support structure 22. Typically, the segment score line 58 intersects the first score line 54 with the segment score line 58 further cut through the liner 32 and the first layer of adhesive 40 to further define the first and second segments 60 removable from the first card portion 46 to expose the second layer of adhesive 42 remaining on the first card portion 46. As discussed above, when the second layer of adhesive 42 is exposed, the coupon card assembly 20 can be adhered to the support structure 22. The segment 56 is entirely or completely removed from the first card portion 46 to expose one of the first and second layers of adhesive 40, 42. More specifically, the first and second segments 60 are entirely or completely removed from the first card portion 46 to expose one of the first and second layers of adhesive 40, 42. It is to be appreciated that more than one segment score line 58 can be utilized.

Typically, turning to FIGS. 6, 10, 11, 21, and 23, the first score line 54 defines a third height $H_3$ of from about 90 percent to about 10 percent of the first total height $H_{T1}$ of the first card portion 46. Referring to FIGS. 10 and 11, the first score line 54 typically defines a minimum of the third height $H_3$ of from about 11.76 percent of the first total height $H_{T1}$ of the first card portion 46 and a maximum of the third height $H_3$ of from about 94.12 percent of the first total height $H_{T1}$. For FIGS. 10 and 11, for example, the minimum of the third height $H_3$ is ¼ inch and the maximum of the third height $H_3$ is ⅛ inch from the first score line 54 to the distal edge 52 of the first card portion 46. In other words, the maximum of the third height $H_3$ is spaced ⅛ inch from the distal edge 52 of the first card portion 46. Therefore, in one configuration, the first total height $H_{T1}$ of the first card portion 46 is 2⅛ inch, the second total height $H_{T2}$ of the second card portion 48 is 2⅛ inch, and the maximum of the third height $H_3$ is 2 inch; as such, the third height $H_3$ is 94.12 percent of the first total height $H_{T1}$ of the first card portion 46.

Figure 21:
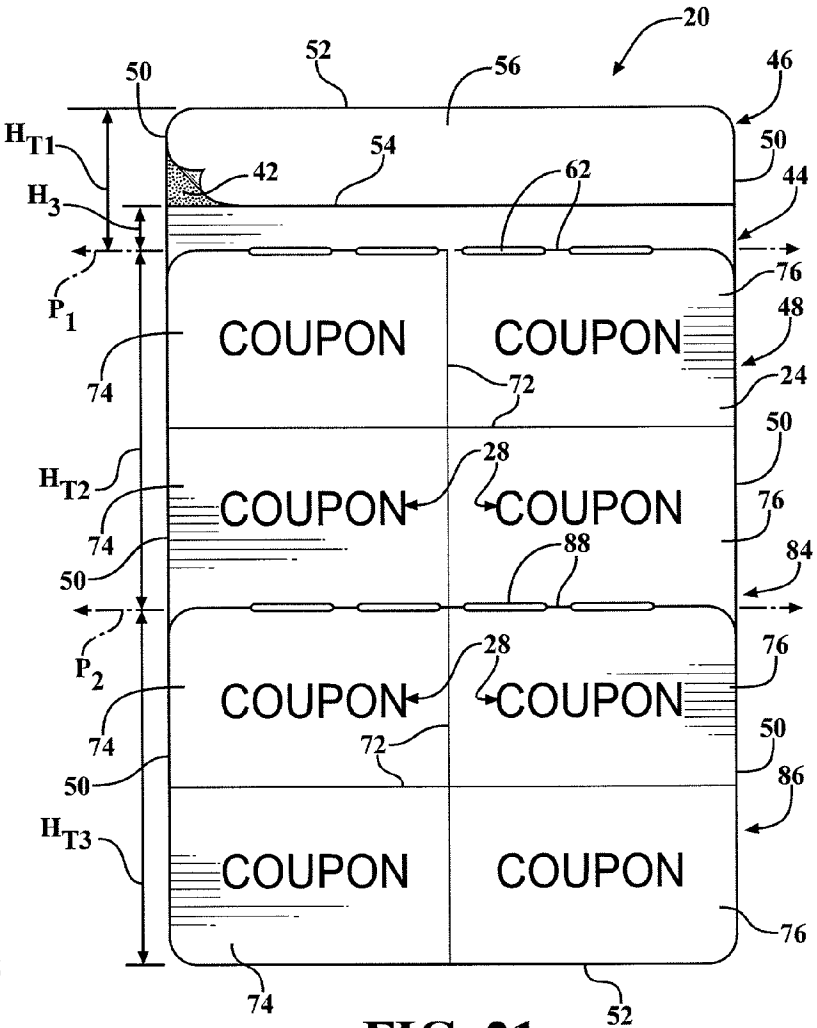
FIG. 21 is a plan view of the back of the coupon card assembly of FIG. 20 with the second and third card portions having coupons thereon and the first layer of material facing out.
Figure 20:
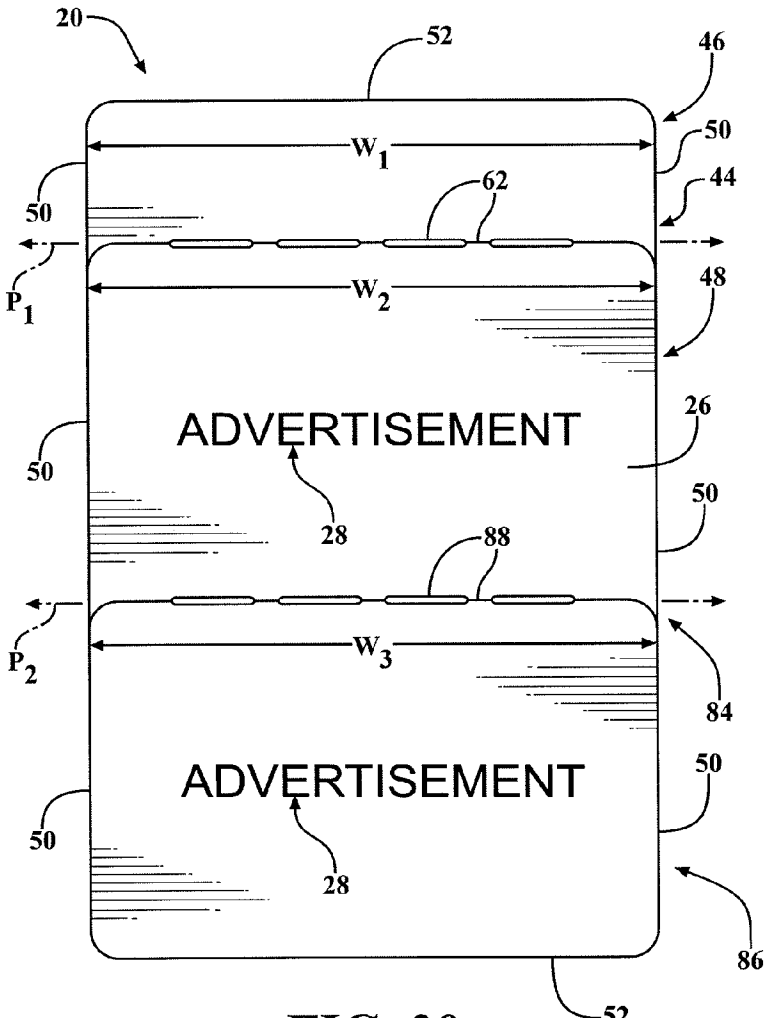
FIG. 20 is a plan view of the coupon card assembly including a second hinge and a third card portion with the second layer of material facing out and the second and third card portions having advertisement thereon.
Figure 23:
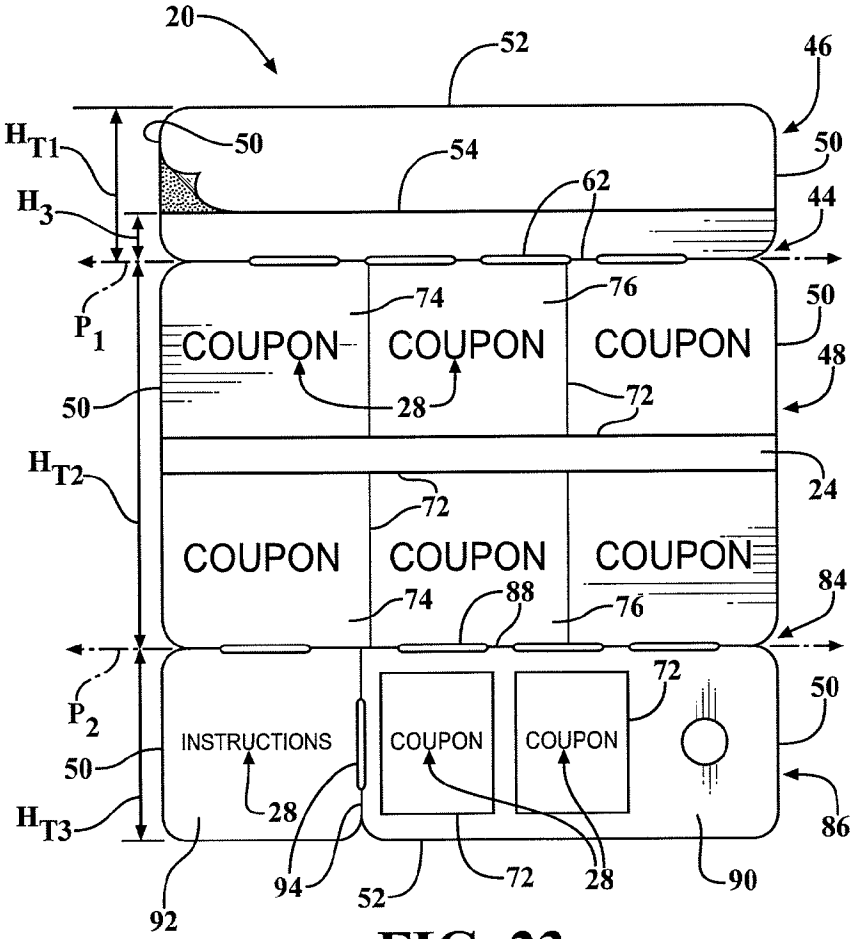
FIG. 23 is a plan view of the back of the coupon card assembly of FIG. 22 with the second card portion having coupons thereon and the key fob having coupons thereon with the first layer of material facing out.

Referring to FIGS. 6, 21 and 23, the first score line 54 typically defines a minimum of the third height $H_3$ of from about 12.5 percent of the first total height $H_{T1}$ of the first card portion 46 and a maximum of the third height $H_3$ of from about 87.5 percent of the first total height $H_{T1}$. For FIGS. 6, 21, and 23, for example, the minimum of the third height $H_3$ is ⅛ inch and the maximum of the third height $H_3$ is ⅛ inch from the first score line 54 to the distal edge 52 of the first card portion 46. In other words, the maximum of the third height $H_3$ is spaced ⅛ inch from the distal edge 52 of the first card portion 46. Therefore, in one configuration, the first total height $H_{T1}$ of the first card portion 46 is 1 inch, the second total height $H_{T2}$ of the second card portion 48 is 2⅛ inch, and the third height $H_3$ is ½ inch; as such, the third height $H_3$ is 50 percent of the first total height $H_{T1}$ of the first card portion 46. In another configuration, the first total height $H_{T1}$ of the first card portion 46 is 1 inch, the second total height $H_{T2}$ of the second card portion 48 is 2⅛ inch, and the maximum of the third height $H_3$ is ⅞ inch; as such, the third height $H_3$ is 87.5 percent of the first total height $H_{T1}$ of the first card portion 46. The third height $H_3$ for any of the configurations of the first card portion 46 can be any suitable percentage of the first total height $H_{T1}$ for exposing a sufficient amount of one of the first and second layers of adhesive 40, 42. In addition, the third height $H_3$ for any of the configurations of the first card portion 46 can be any suitable percentage of the first total height $H_{T1}$ for maintaining the integrity of the hinge 44.

As best shown in FIGS. 4-7 and 10, the hinge 44 includes at least one cut line 62 through the first and second layers of material 24, 26 and the liner 32 along the pivot axis $P_1$ such that the second card portion 48 is movable relative to the first card portion 46. In other words, when the first card portion 46 is attached to the support structure 22, the second card portion 48 is movable about the pivot axis $P_1$. Typically, the cut line 62 of the hinge 44 is spaced from the first score line 54 of the first card portion 46. The at least one cut line 62 is further defined as a plurality of cut lines 62 through the first and second layers of material 24, 26 and the liner 32 with the cut lines 62 spaced from each other. Specifically, the cut line 62 and more specifically the cut lines 62 are further cut through the first and second layers of adhesive 40, 42. For illustrative purposes only, the cut lines 62 are exaggerated in the Figures.

Referring to FIGS. 7, 8 and 10, the hinge 44 includes a second score line 64 disposed along the width $W_1$, $W_2$ of one of the first and second card portions 46, 48 and spaced from the pivot axis $P_1$. More specifically, the second score line 64 is spaced from the cut lines 62. Typically as shown in FIGS. 7, 8 and 10, the second score line 64 is disposed along the width $W_1$ of the first card portion 46 and offset from the first score line 54. The second score line 64 defines a fourth height $H_4$ of from about 50 percent to about 5 percent of the first total height $H_{T1}$ of the first card portion 46. Typically, the second score line 64 defines a minimum of the fourth height $H_4$ of from about 5.88 percent of the first total height $H_{T1}$ of the first card portion 46. For example, the minimum of the fourth height $H_4$ is ⅛ inch. Therefore, in one configuration, the first total height $H_{T1}$ of the first card portion 46 is 2⅛ inch and the fourth height $H_4$ is ⅛ inch; as such, the fourth height $H_4$ is 5.88 percent of the first total height $H_{T1}$ of the first card portion 46. Referring to FIG. 5, the second score line 64 is cut through the second layer of material 26 and the second layer of adhesive 42 of the first card portion 46. Alternatively, the second score line 64 is disposed along the width $W_2$ of the second card portion 48 with the second score line 64 cut through the second layer of material 26 and the second layer of adhesive 42 of the second card portion 48. The fourth height $H_4$ for any of the configurations of the first card portion 46 can be any suitable percentage of the first total height $H_{T1}$ for maintaining the integrity of the hinge 44.

Referring back to FIGS. 7, 8 and 10, the second score line 64 is disposed along the width $W_1$ of the first card portion 46 and the hinge 44 includes a third score line 66 disposed along the width $W_2$ of the second card portion 48. The third score line 66 is spaced from the pivot axis $P_1$ and more specifically, the third score line 66 is spaced from the cut lines 62. The third score line 66 defines a fifth height $H_5$ of from about 50 percent to about 5 percent of the second total height $H_{T2}$ of the second card portion 48. Typically, the third score line 66 defines a minimum of the fifth height $H_5$ of from about 5.88 percent of the second total height $H_{T2}$ of the second card portion 48. For example, the minimum of the fifth height $H_5$ is ⅛ inch. Therefore, in one configuration, the second total height $H_{T2}$ of the second card portion 48 is 2⅛ inch and the fifth height $H_5$ is ⅛ inch; as such, the fifth height $H_5$ is 5.88 percent of the second total height $H_{T2}$ of the second card portion 48. The fifth height $H_5$ for any of the configurations of the second card portion 48 can be any suitable percentage of the second total height $H_{T2}$ for maintaining the integrity of the hinge 44.

Turning to FIGS. 5, 7 and 8, the second score line 64 is cut through the second layer of material 26 and the second layer of adhesive 42 of the first card portion 46 and the third score line 66 is cut through the second layer of material 26 and the second layer of adhesive 42 of the second card portion 48 such that a part 68 of the hinge 44 is removable from the first and second card portions 46, 48 for allowing the first and second card portions 46, 48 to fold. In other words, the second card portion 48 rotates about the pivot axis $P_1$ and folds over the first card portion 46 such that the first and second card portions 46, 48 abut each other. Said differently, the coupon card assembly 20 is movable between an open position as shown in FIGS. 1, 3, 6-11, and 20-23 and a closed position as shown in FIG. 2. Optionally, a latch or tab (not shown) can be secured to at least one of the first and second layers of material 24, 26 and more specifically secured to the exterior surface 30 of at least one of the first and second layers of material 24, 26 for maintaining the coupon card assembly 20 in the closed position.

The part 68 of the hinge 44 is typically a substantially rectangular shaped strip. It is to be appreciated that the part 68 of the hinge 44 can be of any suitable shape or design. In addition, the part 68 of the hinge 44 can have an alternative construction without deviating from the scope of the subject invention. The removal of the part 68 of the hinge 44 is particularly advantageous in that the hinge 44 is not unnecessarily stressed and can therefore be made smaller. It is to be appreciated that the cut lines 62 can be of any suitable size or length or even eliminated altogether. The removal of the part 68 of the hinge 44 allows the hinge 44 to be folded with or without the cut lines 62. As mentioned above, for illustrative purposes only, the cut lines 62 are exaggerated in the Figures.

Figure 13:
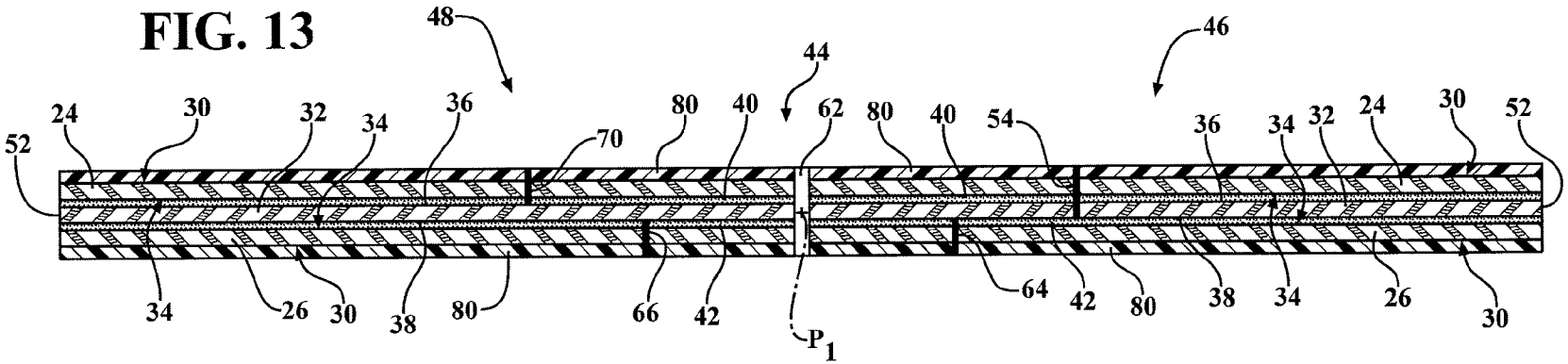
FIG. 13 is a cross-sectional view of the coupon card assembly taken from lines 13-13 of FIG. 11.

In certain alternatives, as shown in FIGS. 11 and 13, the second card portion 48 includes a fourth score line 70 disposed along the width $W_2$ of the second card portion 48 and offset from the third score line 66. The fourth score line 70 is cut through the first layer of material 24 and the first layer of adhesive 40 of the second card portion 48. The fourth score line 70 defines a sixth height $H_6$ of from about 50 percent to about 10 percent of the second total height $H_{T2}$ of the second card portion 48. In this alternative, the fourth score line 70 typically defines a minimum of the sixth height $H_6$ of from about 11.76 percent of the second total height $H_{T2}$ of the second card portion 48. For example, the minimum of the sixth height $H_6$ is ¼ inch. Therefore, in one configuration, the second total height $H_{T2}$ of the second card portion 48 is 2⅛ inch and the sixth height $H_6$ is ¼ inch; as such, the sixth height $H_6$ is 11.76 percent of the second total height $H_{T2}$ of the second card portion 48. The sixth height $H_6$ for any of the configurations of the second card portion 48 can be any suitable percentage of the second total height $H_{T2}$ for maintaining the integrity of the hinge 44.

As best shown in FIGS. 6, 8, and 11, the second card portion 48 includes a coupon score line 72 transverse to the pivot axis $P_1$ and cut through one of the first and second layers of material 24, 26 to define a first coupon 74 and a second coupon 76 removable from the second card portion 48. In other words, the first and second coupons 74, 76 are detachable from the second card portion 48. In one alternative, referring to FIGS. 6 and 14, the coupon score line 72 intersects the cut line 62 to define the first and second coupons 74, 76 with the coupon score line 72 cut through the first layer of material 24 and the first layer of adhesive 40 such that the first and second coupons 74, 76 are removable from the second card portion 48. It is to be appreciated that the coupon score line 72 can intersect the cut line 62 and be cut through the second layer of material 26 and the second layer of adhesive 42.

In another alternative, referring to FIGS. 8 and 15, the second card portion 48 includes the coupon score line 72 transverse to the third score line 66 and intersecting the third score line 66 to define the first and second coupons 74, 76 removable from the second card portion 48. In this alternative, the coupon score line 72 is cut through the second layer of material 26 and the second layer of adhesive 42 such that the first and second coupons 74, 76 are removable from the second card portion 48.

In yet another alternative as shown in FIGS. 11 and 16, the second card portion 48 includes the coupon score line 72 transverse to the fourth score line 70 and intersecting the fourth score line 70 to define the first and second coupons 74, 76 removable from the second card portion 48. In this alternative, the coupon score line 72 is cut through the first layer of material 24 and the first layer of adhesive 40 such that the first and second coupons 74, 76 are removable from the second card portion 48. In other words, for the various alternatives, the coupons 74, 76 can be cut into either of the first and second layers of material 24, 26.

In one alternative, when the first and/or second coupons 74, 76 are removed from the second card portion 48, indicia 28, such as logos or advertisements, etc. can be displayed on the remaining liner 32 or remaining layer of material 24, 26. It is to be appreciated that one coupon 74, 76 or more than two coupons 74, 76 can be removable from the second card portion 48. In other words, one or more coupon score lines 72 can be cut through one of the first and second layers of materials 24, 26 to define one or more coupons 74, 76. As shown in FIGS. 21 and 23, a plurality of coupon score lines 72 are disposed through at least one of the first and second layers of material 24, 26 to define a plurality of coupons 74, 76. As is also appreciated, the fourth score line 70 or the cut line(s) 62 can define one coupon 74, 76 removable from the second card portion 48.

It can be desirable to have one of the first and second layers of adhesive 40, 42 removed with the first and second coupons 74, 76 such that the first and second coupons 74, 76 can be adhered to a redemption sheet at a place of purchase. In addition, since the respective layer of adhesive 40, 42 is removed with the coupons 74, 76, the second card portion 48 that was occupied by the first and second coupons 74, 76 does not have a tacky feel which can be irritating to a user. It is to be appreciated that the first and second coupons 74, 76 can be of any suitable size or configuration with any suitable type of indicia 28 disposed thereon.

Figure 14:
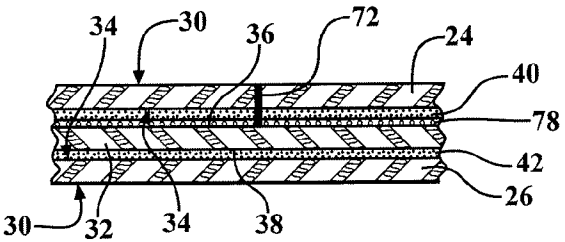
FIG. 14 is a broken cross-sectional view of the second card portion taken from lines 14-14 of FIG. 6.
Figure 17:
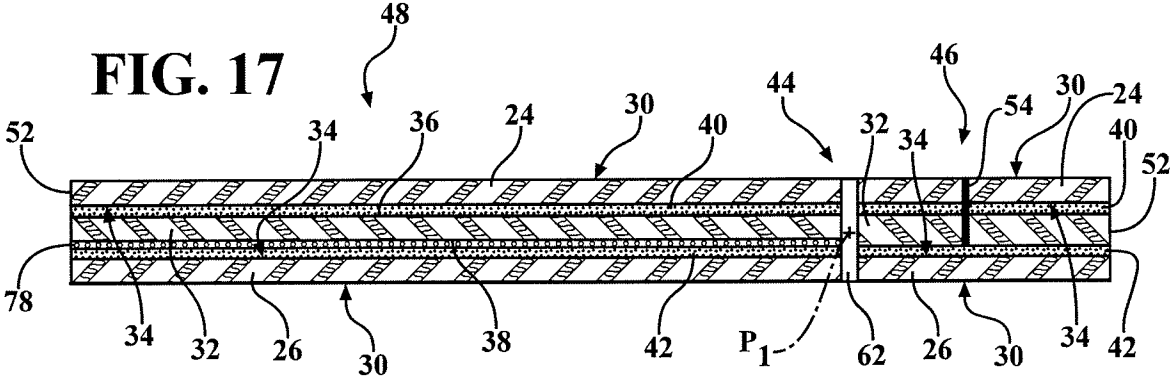
FIG. 17 is a cross-sectional view of the coupon card assembly including the masking disposed on a second side of the liner of the second card portion.
Figure 18:
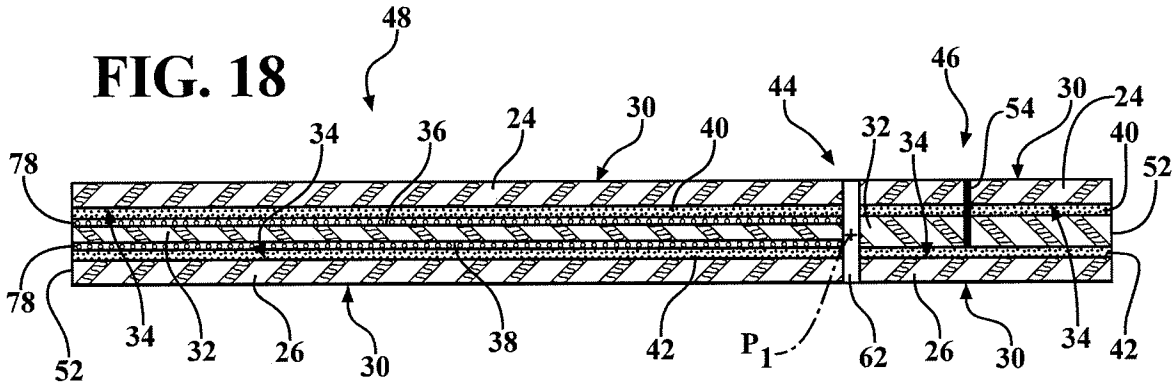
FIG. 18 is a cross-sectional view of the coupon card assembly including the masking disposed on the first and second sides of the liner of the second card portion.

In various alternatives, as shown in FIGS. 4 and 17-19, the coupon card assembly 20 further includes a masking 78 disposed on at least one of the first and second sides 36, 38 of the liner 32 of the second card portion 48 without being disposed on the liner 32 of the first card portion 46 for concealing one of the first and second layers of adhesive 40, 42 of the second card portion 48. In certain alternatives, as shown in FIG. 4, the masking 78 is disposed on the first side 36 of the liner 32 of the second card portion 48. In other alternatives, as shown in FIG. 17, the masking 78 is disposed on the second side 38 of the liner 32 of the second card portion 48. In yet other alternatives, as shown in FIG. 18, the masking 78 is disposed on the first and second sides 36, 38 of the liner 32 of the second card portion 48. For example, when utilizing the masking 78, the coupon score line 72 intersects the cut line 62 to define the first and second coupons 74, 76 removable from the second card portion 48. As shown in FIG. 14, the coupon score line 72 is cut through the first layer of material 24, the first layer of adhesive 40, and the masking 78 such that the first and second coupons 74, 76 are removable from the second card portion 48 with the first layer of adhesive 40 concealed. In other words, when the first and second coupons 74, 76 are removed, the masking 78 conceals the respective first and second layers of adhesive 40, 42. As such, the tacky feel would therefore be eliminated from both the first and second coupons 74, 76 and the second card portion 48. It is to be appreciated that any of the alternatives discussed herein can utilize the masking 78 and when utilizing the masking 78, the score lines 66, 70, 72 and/or the cut line(s) 62 as discussed above are also cut through the masking 78.

Optionally, turning to FIGS. 5, 12, 13, 15, and 16, a laminate 80 can be disposed on at least one of the first and second layers of material 24, 26 to protect the coupon card assembly 20. Typically, the laminate 80 can be disposed on both the first and second layers of material 24, 26. More typically, the laminate 80 can be applied to the exterior surface 30 of the first and/or second layers of material 24, 26. In other words, the laminate 80 can be disposed or adhered to the exterior surface 30 of both or either the first and second layers of material 24, 26. For example, the laminate 80 can be disposed over the indicia 28 and/or printed matter to protect the coupon card assembly 20. When utilizing the laminate 80, the score lines 54, 58, 64, 66, 70, 72 and/or the cut line(s) 62 as discussed above are cut through the respective laminate 80. As one example, when the laminate 80 is disposed on the first layer of material 24, the first score line 54 is cut through the laminate 80 of the first layer of material 24. It is to be appreciated that when the laminate 80 is disposed on the first and second layers of material 24, 26, the score lines 54, 58, 64, 66, 70, 72 and/or the cut line(s) 62 as discussed above are also cut through the laminate 80. The laminate 80 can be utilized with any variation discussed herein.

As another option, as shown in FIG. 19, a varnish 82 can be used to protect the coupon card assembly 20 instead of the laminate 80. In other words, the varnish 82 can be applied to at least one of the first and second layers of material 24, 26. Typically, the varnish 82 can be applied to both the first and second layers of materials 24, 26. More typically, the varnish 82 can be applied to the exterior surface 30 of the first and/or second layers of material 24, 26. It is to be appreciated that when the varnish 82 is disposed on the first and second layers of material 24, 26, the score lines 54, 58, 64, 66, 70, 72 and/or the cut line(s) 62 as discussed above are also cut through the varnish 82. The varnish can be utilized with any variation discussed herein.

In certain alternatives as shown in FIGS. 20-23, the coupon card assembly 20 can include a second hinge 84 partially cut through the first and second layers of material and the liner 32 to define to define a third card portion 86 movable relative to at least one of the first and second card portions 46, 48 about a second pivot axis $P_2$. Typically, the pivot axis $P_1$ and the second pivot axis $P_2$ are substantially parallel to each other. It is to be appreciated that any suitable indicia 28 can be printed or disposed on the third card portion 86.

The third card portion 86 has opposing side edges 50 defining a width $W_3$ therebetween. The width $W_3$ of the third card portion 86 typically equals the width $W_1$, $W_2$ of the first and second card portions 46, 48. It is to be appreciated that the width $W_3$ of the third card portion 86 can be less than or greater than the width $W_1$, $W_2$ of the first and/or second card portions 46, 48 as desired.

The third card portion 86 includes a distal edge 52 adjacent respective side edges 50. The third card portion 86 has a third total height $H_{T3}$ extending from the distal edge 52 of the third card portion 86 to the pivot axis $P_3$. As shown in FIG. 21, the first total height $H_{T1}$ of the first card portion 46 is less than the second total height $H_{T2}$ of the second card portion 48 and also less than the third total height $H_{T3}$ of the third card portion 86. In addition, the second total height $H_{T2}$ of the second card portion 48 can equal the third total height $H_{T3}$ of the third card portion 86. Alternatively, as shown in FIG. 23, the third total height $H_{T3}$ of the third card portion 86 can be less than the second total height $H_{T2}$ of the second card portion 48. It is to be appreciated that the first, second, and/or third total height $H_{T1}$, $H_{T2}$ $H_{T3}$ of the first, second, and/or third card portions 46, 48, 86 can be equal to, less than, or greater than each other as desired.

The second hinge 84 includes at least one cut line 88 through the first and second layers of material and the liner 32 along the second pivot axis $P_2$ such that the third card portion 86 is movable relative to the second card portion 48 and/or the first card portion 46. In other words, when the first card portion 46 is attached to the support structure 22, the third card portion 86 is movable about the second pivot axis $P_2$. Typically, the cut line 88 of the second hinge 84 is spaced from the first score line 54 of the first card portion 46. The at least one cut line 88 is further defined as a plurality of cut lines 88 through the first and second layers of material 24, 26 and the liner 32 with the cut lines 88 spaced from each other. Specifically, the cut line 88 and more specifically the cut lines 88 are further cut through the first and second layers of adhesive 40, 42. For illustrative purposes only, the cut lines 88 are exaggerated in the Figures.

Referring to FIGS. 21 and 23, a plurality of coupon score lines 72 are cut through one of the first and second layers of material 24, 26 to define a plurality of coupons 74, 76 removable from the second and third card portions 48, 86. In other words, the coupons 74, 76 are detachable from the first layer of material 24 of the second and/or third card portions 48, 86 as discussed above. Alternatively, the coupons 74, 76 can be detachable from the second layer of material 26 of the second and/or third card portions 48, 86 as discussed above. The masking 78 can be disposed on at least one of the first and second sides 36, 38 of the liner 32 of the second and/or third card portions 48, 86 without being disposed on the liner 32 of the first card portion 46 for concealing one of the first and second layers of adhesive 40, 42 of the second and/or third card portions 48, 86.

Figure 22:
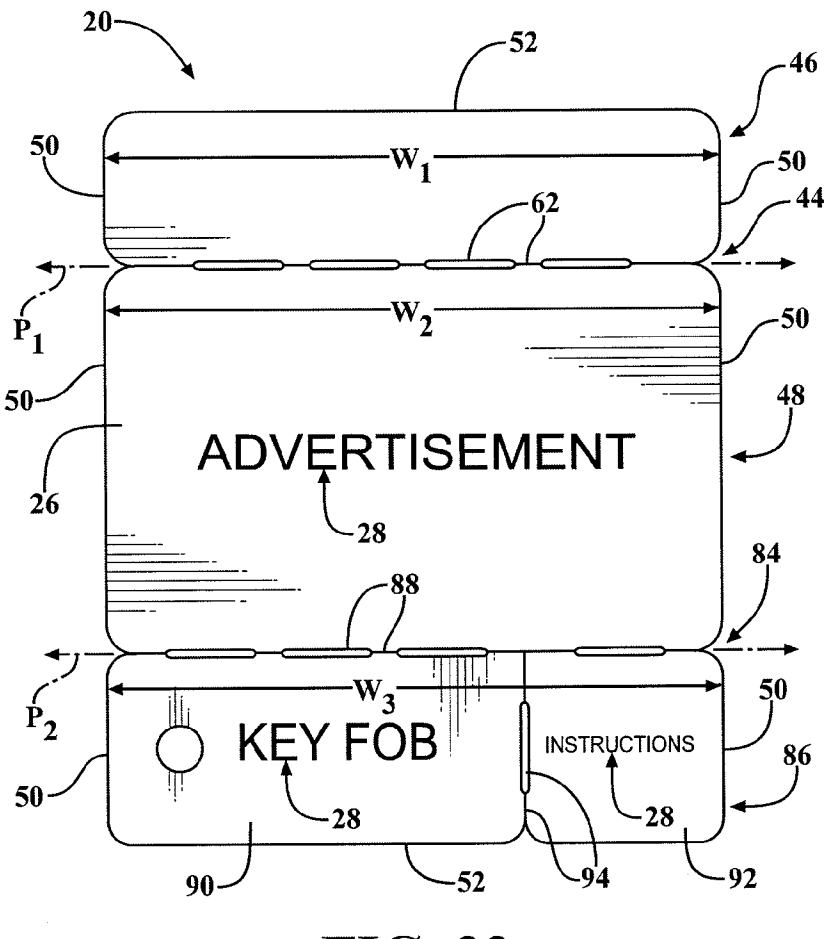
FIG. 22 is a plan view of the coupon card assembly including the third card portion having a key fob with the second layer of material facing out and the second card portion having advertisement thereon.

In the alternative as shown in FIGS. 22 and 23, the third card portion 86 can include a key fob 90 detachable from the second card portion 48. Optionally, the third card portion 86 can include instructions 92 or any other suitable indicia 28/printed matter adjacent the key fob 90 for communicating information regarding the key fob 90, coupons 74, 76, advertisement, etc. The key fob 90 and the instructions 92 together define the width $W_3$ of the third card portion 86. A third hinge 94 can interconnect the key fob 90 and the instructions 92 for selectively separating the key fob 90 from the instructions 92. As another option, the key fob 90 can include coupons 74, 76 detachably cut into the third card portion 86 of the first layer of material 24. In another alternative, the key fob 90 can include coupons 74, 76 detachably cut into the third card portion 86 of the second layer of material 26. Alternatively, the instructions 92 can include at least one coupon 74, 76 detachably cut into the third card portion 86. The second and third hinges 84, 94 can be formed as discussed above for the hinge 44. It is to be appreciated that for any of the variations discussed herein, all or some of the corners (not numbered) of the first, second, and/or third portions 46, 48, 86 can be rounded, straight, and/or any other suitable configuration. It is to be appreciated that all of the cross-sectional Figures are exaggerated for illustrative purposes only.

Many modifications and variations of the present invention are possible in light of the above teachings. The foregoing invention has been described in accordance with the relevant legal standards; thus, the description is exemplary rather than limiting in nature. Variations and modifications to the disclosed embodiment can become apparent to those skilled in the art and do come within the scope of the invention. Accordingly, the scope of legal protection afforded this invention can only be determined by studying the following claims.

What is claimed is:

1. A coupon card assembly for attaching to a support structure, said assembly comprising:

a first layer of material;

a second layer of material coupled to said first layer of material;

a liner disposed between said first and second layers of material;

a first layer of adhesive disposed between said first layer of material and said liner for attaching said first layer of material to said liner;

a second layer of adhesive disposed between said second layer of material and said liner for attaching said second layer of material to said liner; and a hinge partially cut through said first and second layers of material and said liner to define a first card portion and a second card portion movable relative to said first card portion about a pivot axis with said first and second card portions each having opposing side edges defining a width therebetween;

said first card portion including a score line disposed along said width and cut through said first layer of material, said first layer of adhesive, and said liner to define a segment of said first layer of material, said first layer of adhesive, and said liner removable from said first card portion to expose said second layer of adhesive remaining on said first card portion for attaching said first card portion to the support structure;

said score line spaced from said pivot axis with at least a portion of said hinge continuing to include both of said first and second layers of material such that said hinge remains functional after removing said segment.

2. An assembly as set forth in claim 1 wherein said first and second card portions each include a distal edge adjacent respective side edges with said first card portion having a first total height extending from said distal edge of said first card portion to said pivot axis and said second card portion having a second total height extending from said distal edge of said second card portion to said pivot axis.

3. An assembly as set forth in claim 2 wherein said first total height of said first card portion is less than said second total height of said second card portion.

4. An assembly as set forth in claim 2 wherein said first total height of said first card portion equals said second total height of said second card portion.

5. An assembly as set forth in claim 2 wherein said score line defines said third height of from about 90 percent to about 10 percent of said first total height of said first card portion.

6. An assembly as set forth in claim 1 wherein said hinge includes at least one cut line through said first and second layers of material and said liner along said pivot axis such that said second card portion is movable relative to said first card portion with said cut line spaced from said score line.

7. An assembly as set forth in claim 6 wherein said at least one cut line is further defined as a plurality of cut lines through said first and second layers of material and said liner with said cut lines spaced from each other.

8. An assembly as set forth in claim 1 wherein said score line is further defined as a first score line and wherein said hinge includes a second score line disposed along said width of one of said first and second card portions and spaced from said pivot axis.

9. An assembly as set forth in claim 8 wherein said second score line is disposed along said width of said first card portion and offset from said first score line with said second score line cut through said second layer of material and said second layer of adhesive of said first card portion.

10. An assembly as set forth in claim 8 wherein said second score line is disposed along said width of said second card portion with said second score line cut through said second layer of material and said second layer of adhesive of said second card portion.

11. An assembly as set forth in claim 8 wherein said second score line is disposed along said width of said first card portion and wherein said hinge includes a third score line disposed along said width of said second card portion and spaced from said pivot axis with said second score line cut through said second layer of material and said second layer of adhesive of said first card portion and said third score line cut through said second layer of material and said second layer of adhesive of said second card portion such that a part of said hinge is removable from said first and second card portion for allowing said first and second card portions to fold such that said first and second card portions abut each other.

12. An assembly as set forth in claim 11 wherein said second card portion includes a fourth score line disposed along said width of said second card portion and offset from said third score line with said fourth score line cut through said first layer of material and said first layer of adhesive of said second card portion.

13. An assembly as set forth in claim 12 wherein said second card portion includes a coupon score line transverse to said fourth score line and intersecting said fourth score line to define a first coupon and a second coupon removable from said second card portion with said coupon score line cut through said first layer of material and said first layer of adhesive such that said first and second coupons are removable from said second card portion.

14. An assembly as set forth in claim 1 wherein said second card portion includes a coupon score line transverse to said pivot axis and cut through one of said first and second layers of material to define a first coupon and a second coupon removable from said second card portion.

15. An assembly as set forth in claim 14 wherein said hinge includes at least one cut line through said first and second layers of material and said liner along said pivot axis and wherein said coupon score line intersects said cut line to define said first and second coupons with said coupon score line cut through said first layer of material and said first layer of adhesive such that said first and second coupons are removable from said second card portion.

16. An assembly as set forth in claim 1 wherein said score line is further defined as a first score line and wherein said first card portion includes a segment score line transverse to said first score line and cut through said first layer of material to define a first segment and a second segment of said first layer of material removable from said first card portion to expose one of said first and second layers of adhesive remaining on said first card portion for attaching said first card portion to the support structure.

17. An assembly as set forth in claim 16 wherein said segment score line intersects said first score line with said segment score line further cut through said liner and said first layer of adhesive to further define said first and second segments removable from said first card portion to expose said second layer of adhesive remaining on said first card portion.

18. An assembly as set forth in claim 1 wherein said liner includes a first side and a second side opposing said first side and further including a masking disposed on at least one of said first and second sides of said liner of said second card portion without being disposed on said liner of said first card portion for concealing one of said first and second layers of adhesive of said second card portion.

* * * * *